United States Patent [19]

Spann

[11] 4,185,813

[45] Jan. 29, 1980

[54] SURGICAL BODY POSITIONER

[76] Inventor: Donald C. Spann, 5 Ferncreek Ct., Greenville, S.C. 29601

[21] Appl. No.: 906,980

[22] Filed: May 17, 1978

[51] Int. Cl.[2] ..... A61G 13/00

[52] U.S. Cl. ..... 269/328; 248/356

[58] Field of Search ..... 269/328; 5/327 R; 128/83, 133; 248/356, 1

[56] References Cited

U.S. PATENT DOCUMENTS

| | | | |
|---|---|---|---|
| 1,879,826 | 9/1932 | Shaffer | 248/356 |
| 3,505,994 | 4/1970 | Smith | 5/327 R X |
| 3,511,233 | 5/1970 | Holy | 5/327 R |
| 3,532,336 | 10/1970 | Baker | 259/328 |
| 3,995,846 | 12/1976 | Frick | 269/328 |

*Primary Examiner*—Robert C. Watson

*Attorney, Agent, or Firm*—Bailey, Dority & Flint

[57] ABSTRACT

Apparatus for positioning the body of a patient during open heart surgery and the like includes a pair of spaced leg supports each having a leg support surface which includes resilient thigh and calf support surfaces having a sloping contour for positioning the leg in a rotated position affording access thereto for vein removal and a foot support for supporting the foot and ankle portion at a desired elevation and pressure.

20 Claims, 5 Drawing Figures

SURGICAL BODY POSITIONER

BACKGROUND OF THE INVENTION

The proper positioning and support of a patient's legs during open heart surgery is a problem to which considerable attention need be given. Open heart surgery is a delicate operation which typically includes removing for transplant the femoral or saphenous vein from the patient's leg requiring that the leg be positioned and held stationary. Heretofore, these positions were difficult to obtain as the common way to position was by placing folded towels and sheets under the patient's leg. Furthermore, damage to the peroneal nerve in the area behind the knee joint can occur as a result of too much pressure exerted thereon. During the operation, the ankle bones of the foot are often allowed to contact the operating room table surface and are often a common site, along with the heels, for the formation of decubitus ulcers (bedsores) due to the excessive pressure thereagainst which cuts off capillary blood flow. In addition, the capillaries are not normally supplied when a patient is life-supported on a heart pump which increases the incidence of decubitus formations greatly.

Accordingly, an important object of the present invention is to provide a body positioner apparatus for properly supporting and positioning the legs of a patient.

Another important object of the present invention is the provision of a surgical support device which positions the leg in an externally rotated position affording convenient access thereto for vein removal during surgery.

Still another important object of the present invention is a surgical leg supporting device which supports a leg of a patient during open heart surgery with essentially zero pressure on the peroneal nerve area of the leg.

Still another important object of the present invention is the provision of a leg support and positioning device and a unique adjustable ankle support for supporting the foot and ankle portion at a desired elevation and pressure having the versaltility of affording zero pressure against the ankle bone area.

Still another important object of the present invention is to provide apparatus for positioning the legs of a patient having a pair of resilient deformable leg support and positioning surfaces which accommodate different thigh and calf shape and weights.

SUMMARY OF THE INVENTION

It has been found that a body positioner which is particularly advantageous for positioning the body of a patient during open heart surgery can be had by providing a pair of spaced leg supports each having a leg support surface which includes a resilient deformable thigh support surface having a sloping contour for properly positioning the thigh portion of the leg and a resilient deformable calf support surface having a sloping contour for properly positioning the calf portion of the leg. A depression intermediate the thigh and calf support surfaces affords substantially zero pressure on the peroneal nerve while the thigh and calf support surfaces position the leg in an externally rotated position affording convenient access thereto. A foot support contiguous with the calf support surface affords adjustable pressure against the foot and ankle portions of the leg.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
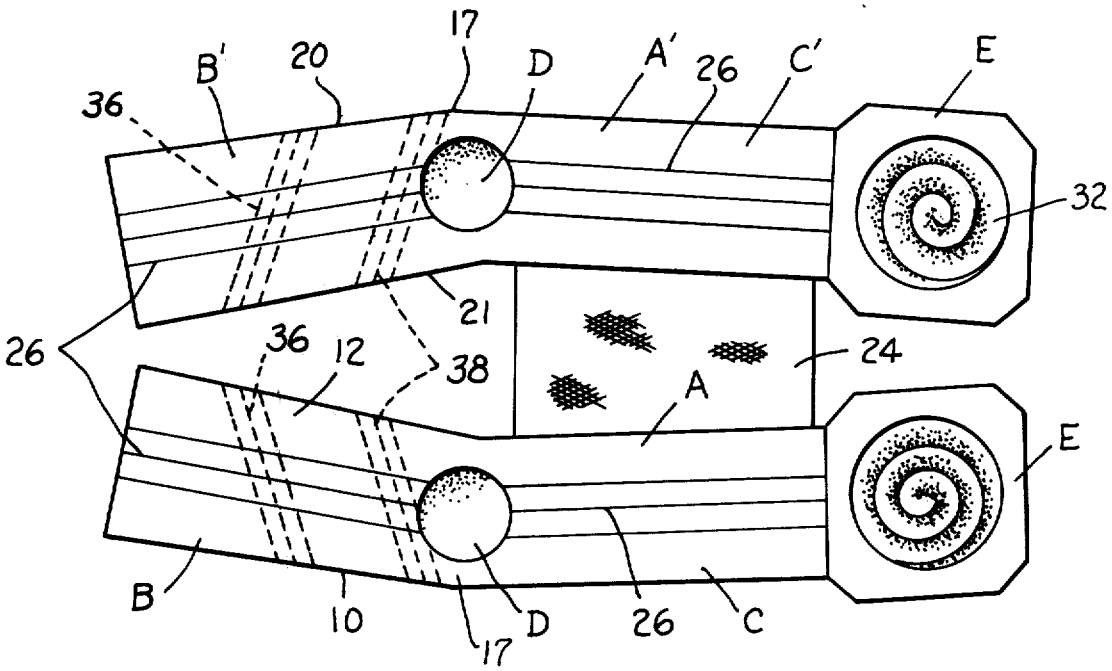
FIG. 1 is a top plan view of a surgical body positioning apparatus according to the present invention.
Figure 2:
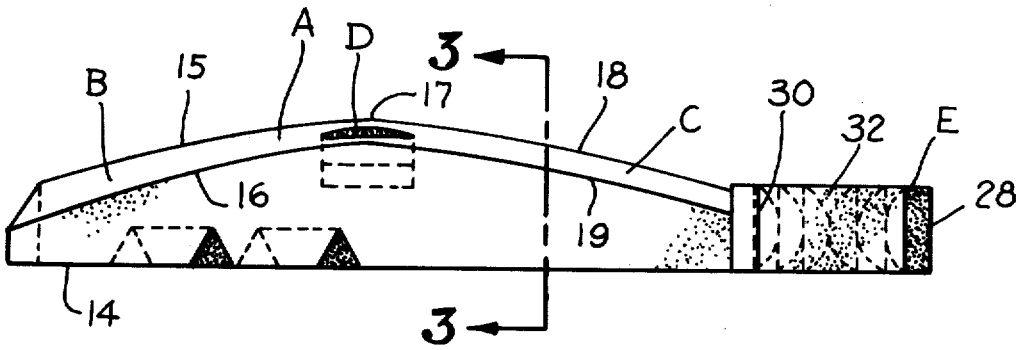
FIG. 2 is an elevational view illustrating one of the leg supports of the apparatus of FIG. 1.
Figure 3:
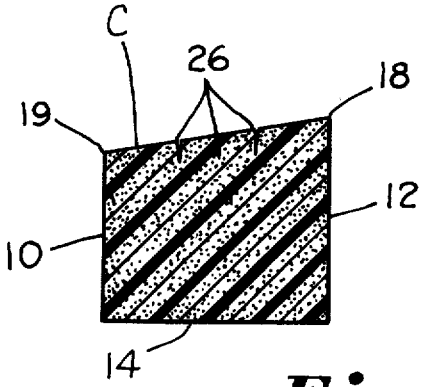
FIG. 3 is a sectional view taken along 3—3 of FIG. 2.
Figure 5:
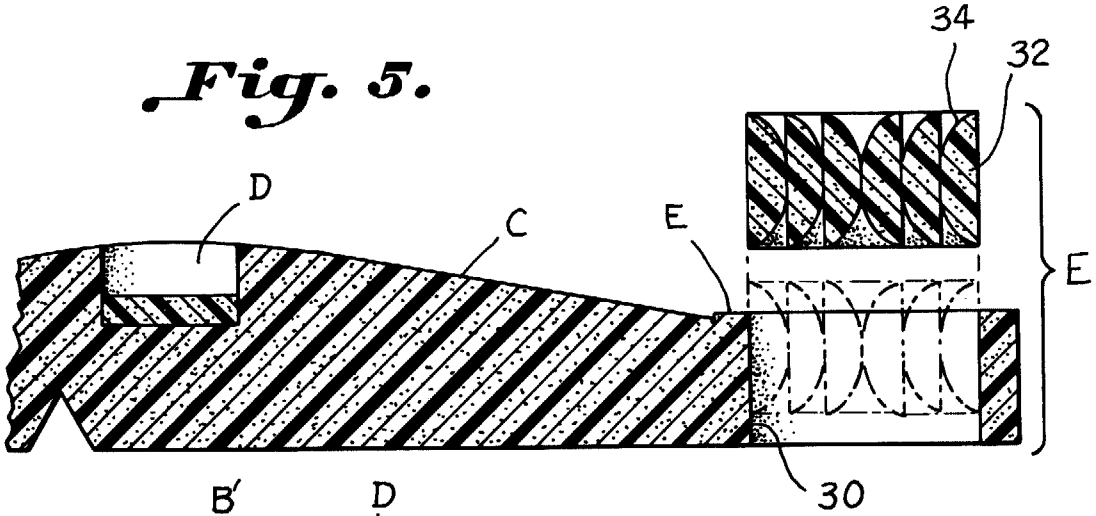
FIG. 5 is a sectional view taken along line 5—5 of FIG. 4.

The drawings illustrate apparatus for positioning the body of a patient during open heart surgery and the like which includes a pair of spaced leg supports A and A' each having a leg support surface for supporting a leg of the patient which includes a thigh support surface B and B' having a sloping contour for properly positioning the thigh, and a calf support surface C and C' having a sloping contour for properly positioning the calf. The thigh and calf support surfaces position the leg in an externally rotated position affording access thereto for the removal of the femoral or saphenous vein. A depression means D is provided intermediate the thigh and calf support surfaces affording substantially zero pressure on the peroneal nerve area in the back of the knee joint and a foot support means E provides support for the foot and ankle portions of the leg.

Referring now in more detail to the drawing, the leg support A is illustrated as including a block of resilient deformable material such as a high density polyurethane foam having planar sides 10 and 12 and a planar bottom surface 14. The thigh support surface B includes a sloping contour which slopes upwardly in the longitudinal direction where it reaches a peak at 17 and thereafterwards slopes downwardly in a longitudinal direction to form the contour of the calf supporting surface C. The thigh support surface B is sloped in the lateral direction from a high edge 15 to a low edge 16. Likewise, the calf support surface slopes from a high edge 18 laterally down to a low edge 19 for proper positioning of the calf. Intermediate the calf and thigh support surfaces is depression D which provides means for relieving pressure against the peroneal nerve area of the leg. The depression means D is provided by a circular cut-out or void of material in the area which supports the back of the knee joint.

The spaced leg support A' is constructed from a block of resilient deformable material in a like manner having opposed planar sides 20 and 21 and a planar bottom surface 22. The leg support A' is like that of A except that the thigh support surface B' and the calf support surface C' are angled and laterally contoured opposite to that of the thigh and calf support surfaces of leg support A. The thigh support surface B' slopes from the high side which is at 21 to the low side which is at 20 as does calf support surface C'. The patient's legs will be rotated so as to expose the inside portions of the thigh and calf for convenient and stable access for vein removal. The thigh and calf support surfaces B' and C' are sloped longitudinally in the same manner as leg support A. It is noted that the thigh support surfaces have a greater slope than the calf support surfaces. A web of material 24 extends between the leg supports A and ' as an expedient to their positioning in the proper angular relation as well as limiting the lateral separation therebetween.

Figure 4:
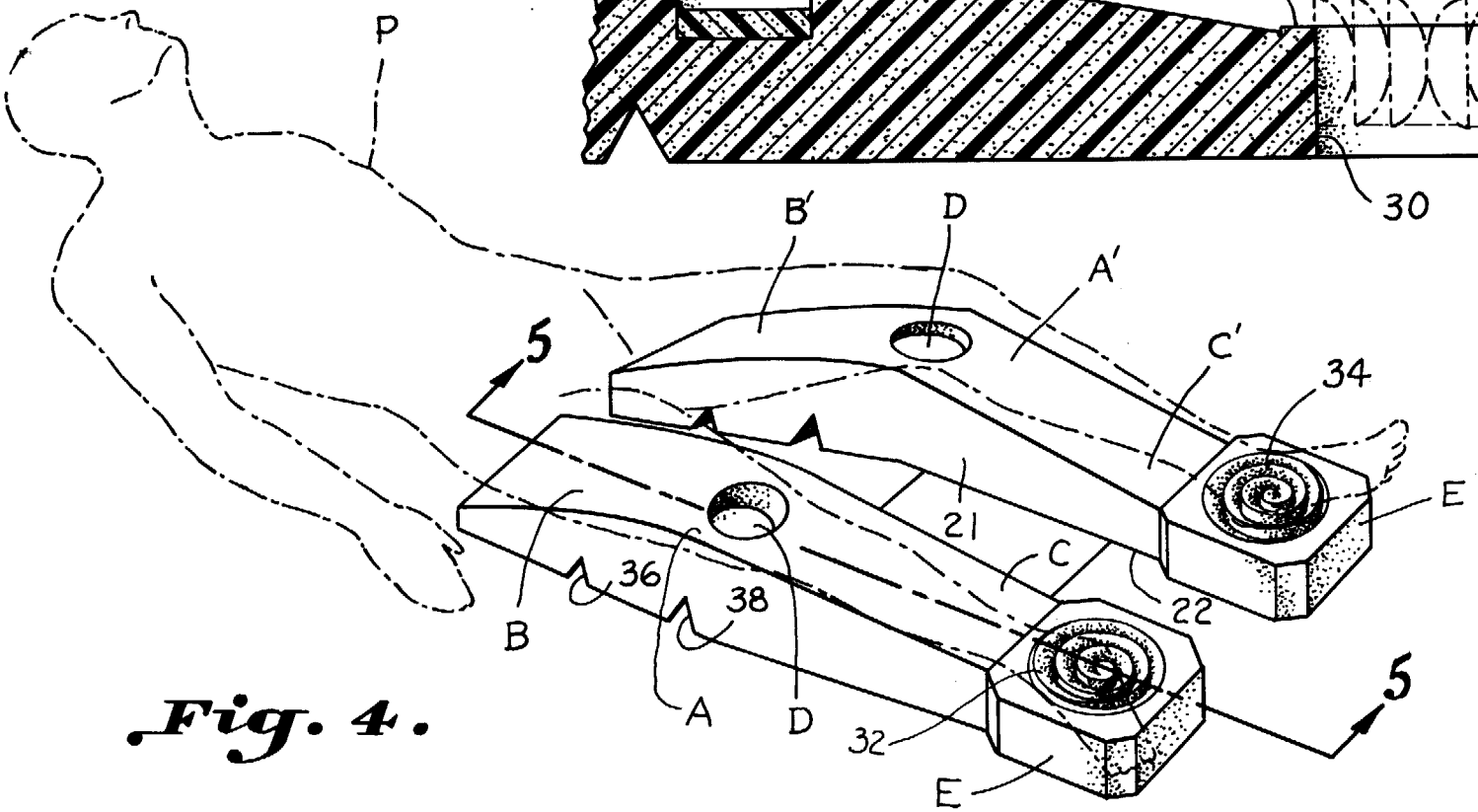
FIG. 4 is a perspective view illustrating surgical body positioning apparatus according to the invention supporting the legs of a patient in a proper and stable position.

As best illustrated in FIG. 4, the patient's legs are externally rotated or turned outwardly exposing the inside portion of the thigh and calf with the thigh being inclined upwardly and the calf being inclined slightly downwardly with the foot and ankle portion supported on support means E. Pressure distribution means is provided by elongated slits 26 which extend lengthwise in the thigh and calf support surfaces of B and B' and C and C'. The slits serve to break the integrity of the support surfaces to accommodate differences in thigh and calf shapes and weights and evenly distributing the pressure.

The foot support means E includes a block member 28 having a hollow recess opening 30 formed therein in which a friction member 32 is frictionally received and held therein. The foot support means E provides a foot support which is adjustable in its elevation and in the pressure exerted against the ankle portion of the foot. By means of pulling and pushing the friction member 32 in and out of the recess opening 30, the friction member and foot portions supported thereon may be adjusted to any desired elevation. The friction member 32 may be completely removed from the recess opening, in which condition the foot is supported with essentially zero pressure on the ankle bone portion. This may be advantageous in some situations where the patient must remain on the positioning apparatus for long periods of time whereby the formation of bedsores on the ankle portion is reduced. As illustrated, the friction member 32 includes a curl of resilient deformable strip material which may also be a high density polyurethane foam. The support edges of the strip material are beveled at 34 so as to be deformed and lay against the next adjacent layer under the weight of the foot providing a soft supporting cushion. The inner and outer ends of curl strip 32 are affixed to the remainder of the strip by gluing so that the curl may be moved and removed as a unit.

Thus, the foot support E affords a choice of zero pressure with curl 32 removed completely, or the foot may be gently supported by raising the support curl slightly as desired. The coefficient of friction enables the curl to remain in any position at which it is placed and the curl is infinitely adjustable throughout the full range of movement built into the product.

The leg supports A and A' may be made as one piece together with the contiguous foot support E, as illustrated, or the different supporting surfaces may be made as separate blocks with the different pieces being made integral such as by gluing and the like. The bottom surfaces 18 and 22 of the leg supports A and A' include a pair of longitudinally spaced cut-outs 36 and 38 which extend angularly across the bottom surface of the leg supports and provide a means by which tubing, such as urinary drainage tubes, probes, and sensors, etc. may be placed and routed for connection to the patient. These items are placed indwelling and it is important that they remain in place as the patient moves from the operating room to the intensive care unit and often must remain through a lengthy recovery period.

The supporting surfaces of the apparatus are preferably not covered to best use the advantage of the coefficient of friction built into the foam material. This property tends to hold or grip the flesh in such a way that as to prevent shifting or slippage which presents a surgery site to the operating physician in a uniformly accessible and stable position.

Thus, it can be seen that an advantageous construction can be had for apparatus for positioning and supporting the legs of a patient wherein, particularly during open heart surgery, the legs are supported in an externally rotated position affording access thereto for vein removal and with substantially zero pressure on the peroneal nerve avoiding damage thereto. The foot and ankle portion of the leg may be supported at any desired elevation and pressure simply by pushing in or pulling out a friction member which is uniquely designed to provide an outwardly beveled surface for the ankle bone portion which reduces the pressure thereon and the formation of bedsores which often form due to the blood flow being terminated or restricted in the capillaries while the patient is on a heart pump.

While a preferred embodiment of the invention has been described using specific terms, such description is for illustrative purposes only, and it is to be understood that changes and variations may be made without departing from the spirit or scope of the following claims.

What is claimed is:

1. Apparatus for positioning the body of a patient during heart surgery and the like comprising:

a pair of spaced leg supports each having a leg support surface which includes:

a resilient deformable thigh support surface having a sloping contour for properly positioning the thigh portion of said leg, a resilient deformable calf support surface having a sloping contour for properly positioning the calf portion of said leg, said thigh and calf support surfaces positioning said leg in an externally rotated position affording access thereto, and a knee support portion having pressure relief means for relieving pressure on said leg in the peroneal nerve area avoiding damage thereto.

2. The apparatus of claim 1 wherein each said leg support surfaces includes a depression intermediate the thigh and calf support surfaces affording substantially zero pressure on the peroneal nerve area of the leg.

3. The apparatus of claim 2 wherein said depression is defined by a hollow cut-out portion formed in said leg supporting surface intermediate said thigh and calf supporting surfaces.

4. The apparatus of claim 1 including pressure distribution means serving to break the integrity of said thigh and calf support surfaces accommodating differences in thigh and calf shapes and weights and evenly distributing the pressure thereon.

5. The apparatus of claim 4 wherein said pressure distribution means includes elongated slits extending generally longitudinally in each said thigh and calf support surface.

6. The apparatus of claim 1 including a foot support means for supporting foot and ankle portions of said leg having an adjustable support for supporting said foot and ankle in a variety of elevated positions.

7. The apparatus of claim 1 wherein said foot support means includes a block member integral with said calf support surface, a recess opening formed in said block member, and a removable friction member received in said recess opening and vertically adjustable therein.

8. The apparatus of claim 7 wherein said friction member includes a curled strip of resilient deformable material frictionally held in said recess opening.

9. The apparatus of claim 1 including cut-out means formed in a bottom surface of each said leg support for accommodating the placement and routing of tubing and the like.

10. The apparatus of claim 1 wherein said leg supports are integrally joined by a web limiting the lateral separation therebetween.

11. The apparatus of claim 1 wherein said thigh and calf supporting surfaces have a longitudinal and lateral sloping contour.

12. Apparatus for positioning the body of a patient during surgery comprising:

a pair of spaced leg supports each having a leg support surface for supporting a leg of said patient which includes;

a resilient deformable thigh support surface having a longitudinally and laterally sloping contour for properly positioning the thigh portion of said leg, said laterally sloping contour of said thigh support surface sloping from a high inside edge downwardly to a lower outside edge so as to cause the thigh portion of said leg to be externally rotated when supported thereon, a resilient deformable calf support surface having a longitudinally and laterally sloping contour for properly positioning the calf portion of said leg, and said thigh and calf support surfaces positioning said leg in a proper externally rotated position affording stability and access thereto for surgery.

13. The apparatus of claim 12 including depression means intermediate said thigh and calf support surfaces limiting the pressure on the peroneal nerve area of said leg.

14. The apparatus of claim 12 including foot support means having a vertically adjustable support means for supporting foot and ankle portions of the leg at a desired elevation and pressure.

15. The apparatus of claim 12 including adjustable foot support means affording support of the foot portion of said leg with substantially zero pressure on the ankle bone portion thereof.

16. The apparatus of claim 12 including pressure distribution means serving to break the integrity of said thigh and calf support surfaces accommodating differences in thigh and calf shapes and weights and evenly distributing the pressure thereon.

17. Body positioning apparatus for positioning and supporting the legs of a patient comprising:

leg support means having a leg support surface;

foot support means contiguous with said leg support means for supporting the foot and ankle portion of said leg including;

support block means, a recess opening formed in said support block means, a vertically adjustable support member frictionally received in said recess opening and held therein at a desired elevated position.

18. The apparatus of claim 17 wherein said adjustable support member is movable to a position affording substantially zero pressure on said ankle portion.

19. The apparatus of claim 17 wherein said adjustable support member includes a curl of resilient deformable material.

20. The apparatus of claim 19 wherein said curl of resilient deformable material includes upper beveled support edges.

* * * * *